US011607818B1

(12) United States Patent
Crawford et al.

(10) Patent No.: US 11,607,818 B1
(45) Date of Patent: Mar. 21, 2023

(54) POCKET KNIFE

(71) Applicants: John Crawford, Canton, NC (US); Kyle Chumchal, Fletcher, NC (US)

(72) Inventors: John Crawford, Canton, NC (US); Kyle Chumchal, Fletcher, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

(21) Appl. No.: 17/819,763

(22) Filed: Aug. 15, 2022

(51) Int. Cl.
*B26B 1/08* (2006.01)

(52) U.S. Cl.
CPC ..... *B26B 1/08* (2013.01)

(58) Field of Classification Search
CPC ..... B26B 1/08
USPC ..... 30/162
See application file for complete search history.

(56) References Cited

U.S. PATENT DOCUMENTS

| | | | | |
|---|---|---|---|---|
| 6,085,423 | A | 7/2000 | Marifone | |
| 7,305,769 | B2 | 12/2007 | McHenry | |
| 7,562,455 | B2 | 7/2009 | McHenry | |
| 7,574,804 | B2 | 8/2009 | Bezold | |
| 8,595,941 | B2 | 12/2013 | Lee | |
| 8,671,578 | B1 | 3/2014 | Frazer | |
| 9,375,854 | B2 | 6/2016 | Chu | |
| 9,498,889 | B1 | 11/2016 | Hawk | |
| 9,764,485 | B1 | 9/2017 | Hawk | |
| 10,220,527 | B1 | 3/2019 | Marfione | |
| 10,500,740 | B1 | 12/2019 | Marfione et al. | |
| 10,807,253 | B1 | 10/2020 | Mandeville | |
| 2006/0207102 | A1 | 9/2006 | Bezold | |
| 2007/0068003 | A1* | 3/2007 | Schmidt | B26B 5/001 30/162 |
| 2007/0175045 | A1 | 8/2007 | McHenry | |
| 2008/0222895 | A1 | 9/2008 | Marfione | |
| 2008/0222897 | A1 | 9/2008 | Marfione | |
| 2009/0235534 | A1 | 9/2009 | Chu | |
| 2014/0101943 | A1 | 4/2014 | Chu | |
| 2014/0173911 | A1 | 6/2014 | Chu | |
| 2017/0021511 | A1* | 1/2017 | Chiu | B26B 5/003 |
| 2021/0268671 | A1* | 9/2021 | Buerk | B26B 1/08 |
| 2021/0276204 | A1* | 9/2021 | Marfione | B26B 1/10 |

FOREIGN PATENT DOCUMENTS

| | | | |
|---|---|---|---|
| CN | 108890696 A | * | 11/2018 |
| GB | 214909 | * | 5/1924 |
| GB | 2481070 | * | 12/2011 |
| GB | 2547665 A | * | 8/2017 |
| KR | 20-0240124 | * | 10/2001 |

* cited by examiner

*Primary Examiner* — Hwei-Siu C Payer
(74) *Attorney, Agent, or Firm* — Steve LeBlanc, LLC

(57) ABSTRACT

A pocket knife includes a chassis that defines a left outer surface, a right outer surface, a top outer surface, and a cavity between the left and right outer surfaces. A blade having a cutting edge has a retracted position in which the cutting edge is inside the cavity and a deployed position in which the cutting edge is outside of the cavity. An actuator in sliding contact with the chassis has a shut position that moves the blade to the retracted position and an open position that moves the blade to the deployed position. A left side of the actuator extends beyond the left outer surface of the chassis. A right side of the actuator extends beyond the right outer surface of the chassis. A top side of the actuator extends beyond the top outer surface of the chassis.

18 Claims, 9 Drawing Sheets

POCKET KNIFE

FIELD OF THE INVENTION

The present invention generally involves a pocket knife. In particular embodiments, the pocket knife may be a double action, out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy and/or retract the blade using a single hand. Each design balances the convenience and speed of operation with increased risk associated with inadvertent operation.

A switchblade is a particular style of pocket knife that has a folding or sliding blade that automatically deploys when an actuator is operated. A single action switchblade typically includes a spring under tension with the blade when the blade is retracted, and operation of the actuator releases the blade to allow the spring tension to automatically deploy the blade. Once deployed, the actuator is released to engage a lock that holds the blade in the deployed position. To retract a single action switchblade, the actuator is again operated to disengage the lock, and the blade must be manually retracted against the spring tension.

In contrast, a double action switchblade typically includes a slider, front and rear operators connected by a spring, and front and rear locks. To deploy a double action switchblade, the actuator may be moved forward to move the slider forward. Forward movement of the slider moves the front operator forward while the rear operator is engaged with the rear of the blade to charge the spring. Forward movement of the slider eventually releases the rear lock to allow the charged spring to deploy the blade, and the front lock engages with the deployed blade to hold the blade in the deployed position. To retract a double action switchblade, the actuator is moved rearward to move the slider rearward. Rearward movement of the slider moves the rear operator rearward while the front operator is engaged with the blade to charge the spring. Rearward movement of the slider eventually releases the front lock to allow the charged spring to retract the blade, and the rear lock engages with the retracted blade to hold the blade in the retracted position.

Although a double action switchblade often provides convenient one-handed operation, the amount of force needed to move the actuator to adequately charge the spring to deploy and retract the blade may be difficult for some users. In addition, manufacturing tolerances in the spring may vary the amount of force required to move the actuator and/or reliability of operation. For example, a spring with a higher modulus of elasticity increases the amount of force required to move the actuator, making operation of the switchblade more difficult. Conversely, a spring with a lower modulus of elasticity decreases the amount of force required to move the actuator, making operation of the switchblade less difficult. However, the reduced force applied to the spring may not adequately charge the spring to reliably deploy and retract the blade. Therefore, the need exists for an improved switchblade that may be comfortably operated one-handed while accommodating manufacturing tolerances in the spring.

BRIEF DESCRIPTION OF THE INVENTION

Aspects and advantages of the invention are set forth below in the following description, or may be obvious from the description, or may be learned through practice of the invention.

One embodiment of the present invention is a pocket knife that includes a chassis that defines a left outer surface opposed to a right outer surface, a top outer surface between the left and right outer surfaces, and a cavity between the left and right outer surfaces. A blade having a cutting edge has a retracted position in which the cutting edge is inside the cavity and a deployed position in which the cutting edge is outside of the cavity. An actuator in sliding contact with the chassis has a shut position that moves the blade to the retracted position and an open position that moves the blade to the deployed position. A left side of the actuator extends beyond the left outer surface of the chassis. A right side of the actuator opposed to the left side of the actuator extends beyond the right outer surface of the chassis. A top side of the actuator between the left and right sides of the actuator extends beyond the top outer surface of the chassis.

An alternate embodiment of the present invention is a pocket knife that includes a chassis that defines a left outer surface opposed to a right outer surface, a top outer surface between the left and right outer surfaces, and a cavity between the left and right outer surfaces. A blade having a cutting edge has a retracted position in which the cutting edge is inside the cavity and a deployed position in which the cutting edge is outside of the cavity. A slider inside the cavity has a rear position that moves the blade to the retracted position and a front position that moves the blade to the deployed position. A tab extends from the slider, and an actuator is in sliding contact with the chassis and engaged with the tab so that the actuator and the slider move together. At least one of a left side of the actuator extends beyond the left outer surface of the chassis or a right side of the actuator extends beyond the right outer surface of the chassis.

In yet another embodiment of the present invention, a pocket knife includes a chassis that defines a left outer surface opposed to a right outer surface, a top outer surface between the left and right outer surfaces, and a cavity between the left and right outer surfaces. A blade having a cutting edge has a retracted position in which the cutting edge is inside the cavity and a deployed position in which the cutting edge is outside of the cavity. A slider inside the cavity has a rear position that moves the blade to the retracted position and a front position that moves the blade to the deployed position. A tab extends from the slider, and an actuator is in sliding contact with the chassis and engaged with the tab so that the actuator and the slider move together. A front operator is inside the cavity, and the slider engages with the front operator to move the blade to the deployed position. A rear operator is inside the cavity, and the slider engages with the rear operator to move the blade to the retracted position. A spring is in threaded engagement with at least one of the front operator or the rear operator.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
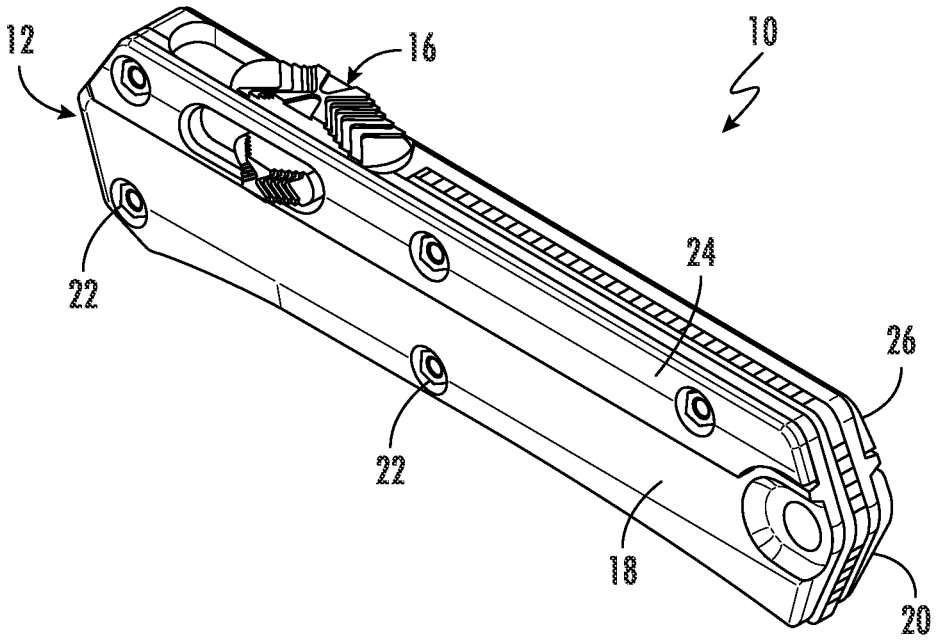
FIG. 1 is a perspective view of a pocket knife according to one embodiment of the present invention in a retracted position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a pocket knife that may be comfortably operated one-handed while accommodating manufacturing tolerances of the internal components. For convention of reference, the term "front" shall refer to the end of the pocket knife from which a blade deploys; the term "rear" shall refer to the end of the pocket knife that is opposite from the front; the term "top" shall refer to the side of the pocket knife that houses an actuator for operating the pocket knife; the term "bottom" shall refer to the side of the pocket knife that is opposite from the top; and the terms "left" and "right" shall refer to the opposing sides of the pocket knife that are adjacent to and generally perpendicular to the top and bottom.

Figure 2:
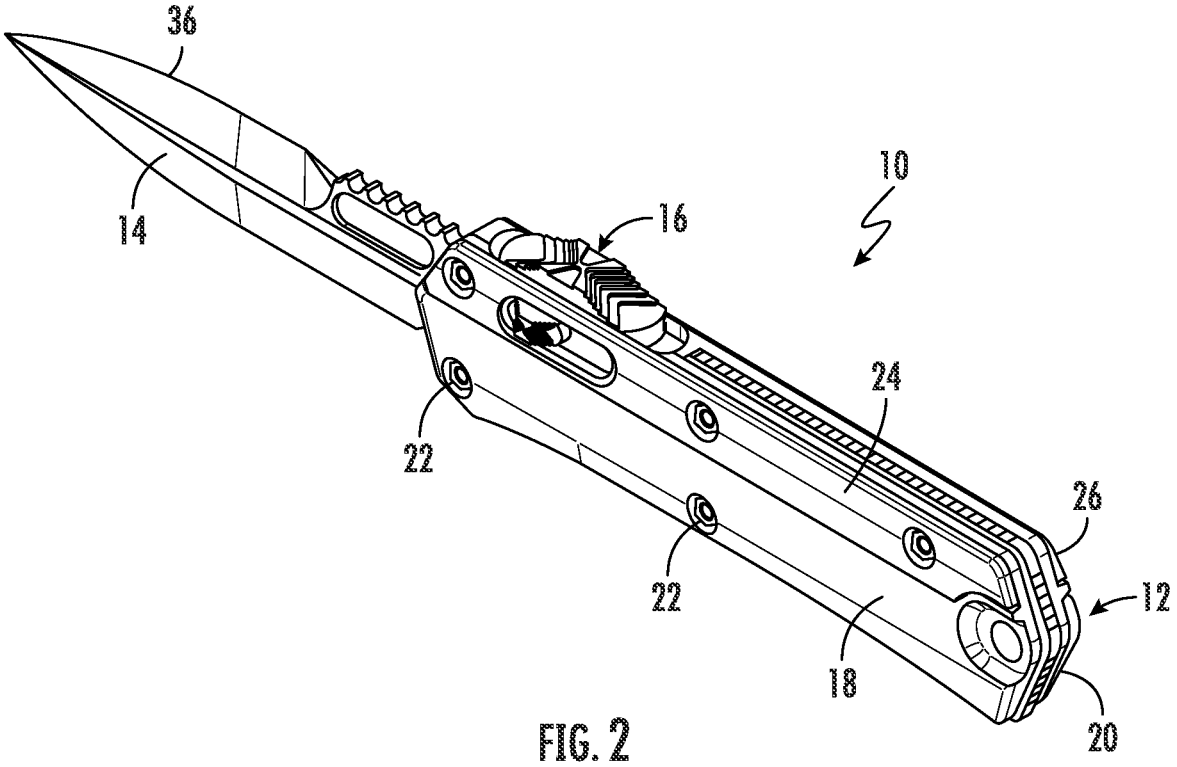
FIG. 2 is a perspective view of the pocket knife shown in FIG. 1 in a deployed position.

FIG. 1 provides a perspective view of a pocket knife 10 according to one embodiment of the present invention in a retracted position, and FIG. 2 provides a perspective view of the pocket knife 10 shown in FIG. 1 in a deployed position. As shown in FIGS. 1 and 2, the pocket knife 10 generally includes a chassis 12, a blade 14, and an actuator 16.

The chassis 12 provides a frame for supporting the various components associated with the pocket knife 10 and may be molded, pressed, or machined from plastics, metals, polymers, or any material or combination of materials having the desired strength and durability. The chassis 12 may be a single piece construction or may be formed from a left chassis 18 connected to a right chassis 20 by screws 22 or other attachment means. As shown in FIGS. 1 and 2, the screws 22 may also attach a left scale 24 and a right scale 26 over some or all of the left and right chassis 18, 20, respectively, for decoration and/or additional support for the actuator 16. In particular embodiments, the screws 22 may be inserted through the left chassis 18 and left scale 24 (if present) to provide threaded engagement with the right chassis 20 without passing through the right chassis 20 or right scale 26 (if present), resulting in a visually clean appearance of the right side of the chassis 12.

Figure 3:
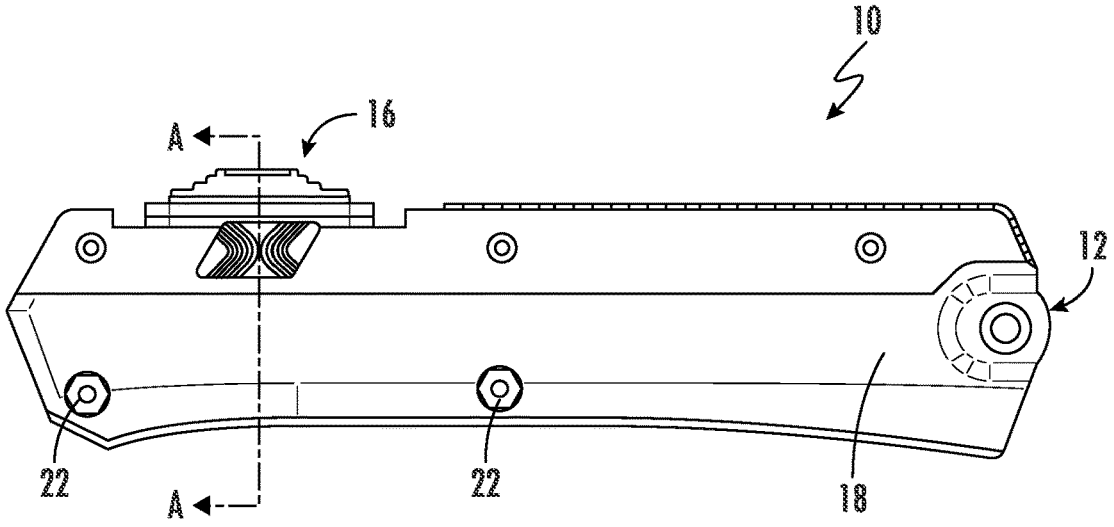
FIG. 3 is a left plan view of the pocket knife shown in FIG. 1 with the left and right scales removed and the actuator in a mid-position.
Figure 4:
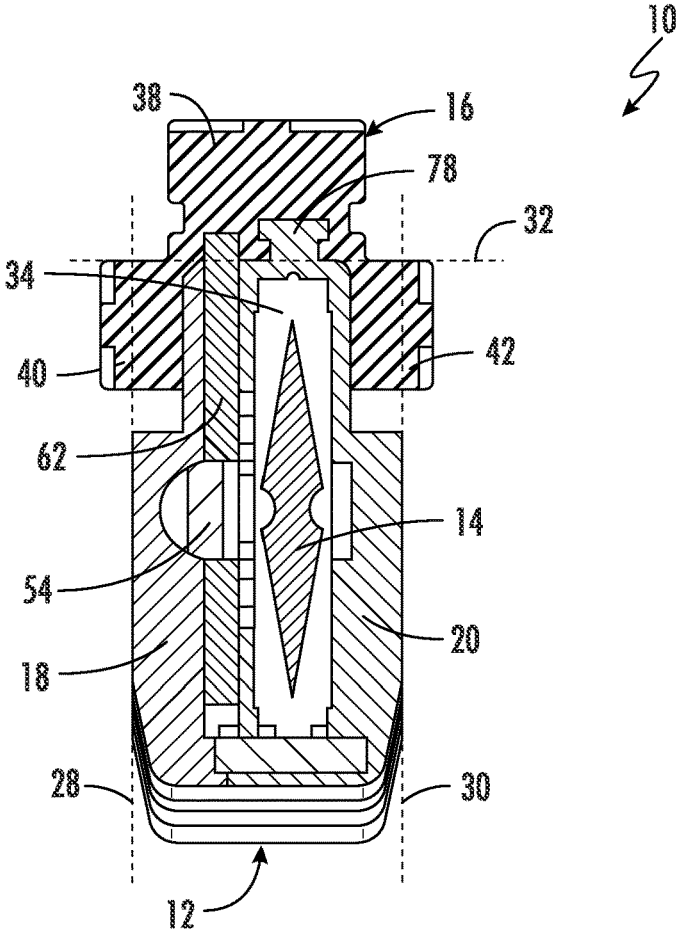
FIG. 4 is an axial cross-section view of the pocket knife shown in FIG. 3 taken along A-A.

FIG. 3 provides a left plan view of the pocket knife 10 shown in FIG. 1 with the left and right scales 24, 26 removed and the actuator 16 in a mid-position, and FIG. 4 provides an axial cross-section view of the pocket knife 10 shown in FIG. 3 taken along A-A. As shown most clearly in FIG. 4, the chassis 12 defines a left outer surface 28 opposed to a right outer surface 30, a top outer surface 32 between the left and right outer surfaces 28, 30, and a cavity 34 between the left and right outer surfaces 28, 30.

The blade 14 generally has one or more cutting edges 36 and can move between retracted and deployed positions. In the retracted position, as shown in FIGS. 1, 3, 4, 6, 8, and 9, the cutting edge 36 is inside the cavity 34 of the chassis 12 to shield the cutting edge 36 from inadvertent contact that might damage the blade 14 or cause harm to personnel or objects. In the deployed position, as shown in FIGS. 2, 10, and 11, the cutting edge 36 is outside of the cavity 34 of the chassis 12 to allow use of the cutting edge 36 as desired.

Figure 8:
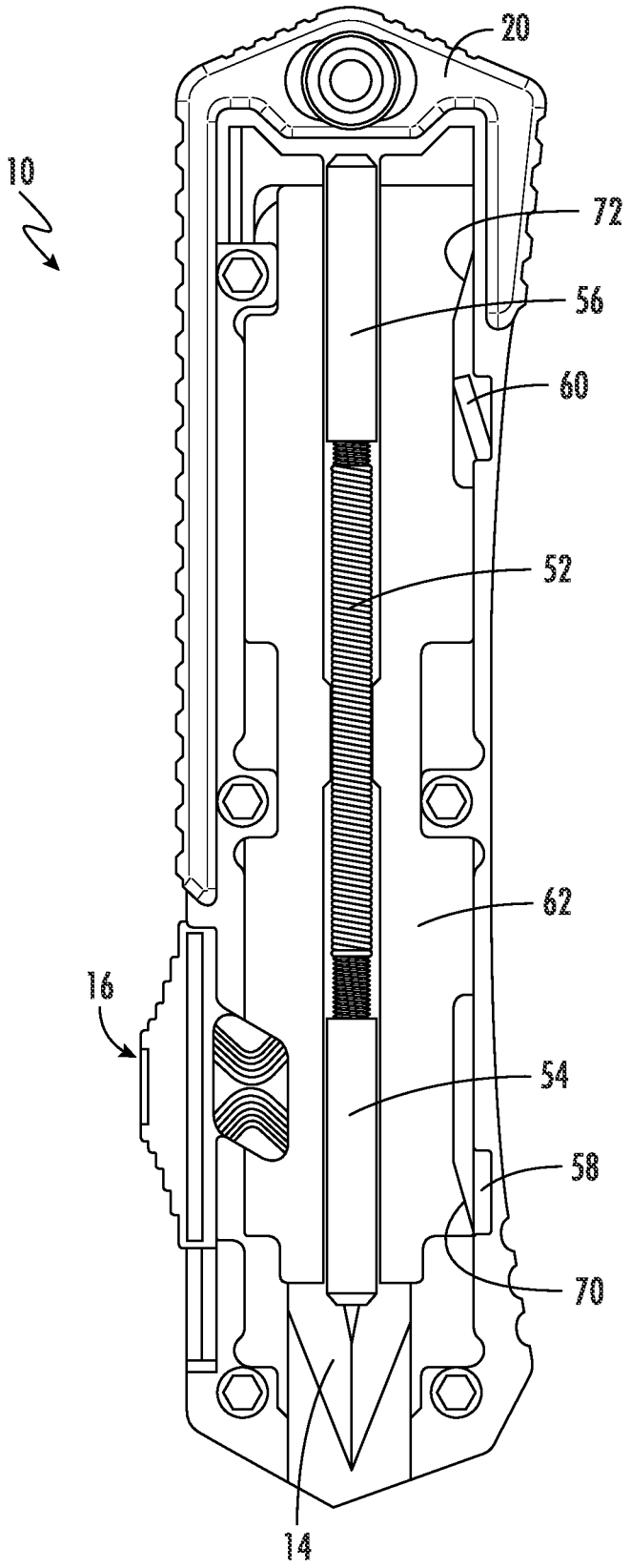
FIG. 8 is a left plan view of the pocket knife shown in FIGS. 1-3 with the left chassis and left scale removed, the blade in the retracted position, the actuator in the shut position, the slider in the rear position, and the rear lock engaged with the blade.
Figure 9:
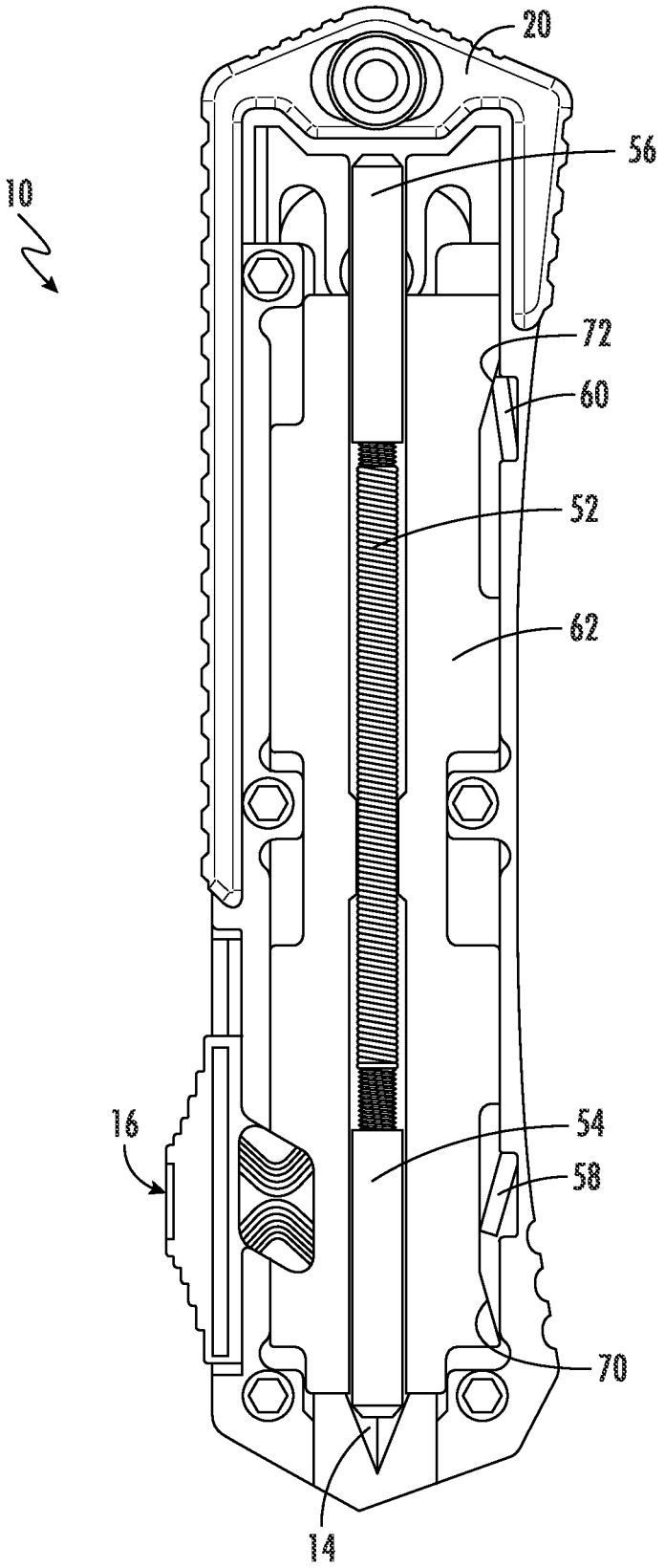
FIG. 9 is a left plan view of the pocket knife shown in FIGS. 1-3 with the left chassis and left scale removed, the blade in the retracted position, the actuator in the open position, the slider in the front position, and the rear lock released from the blade.
Figure 10:
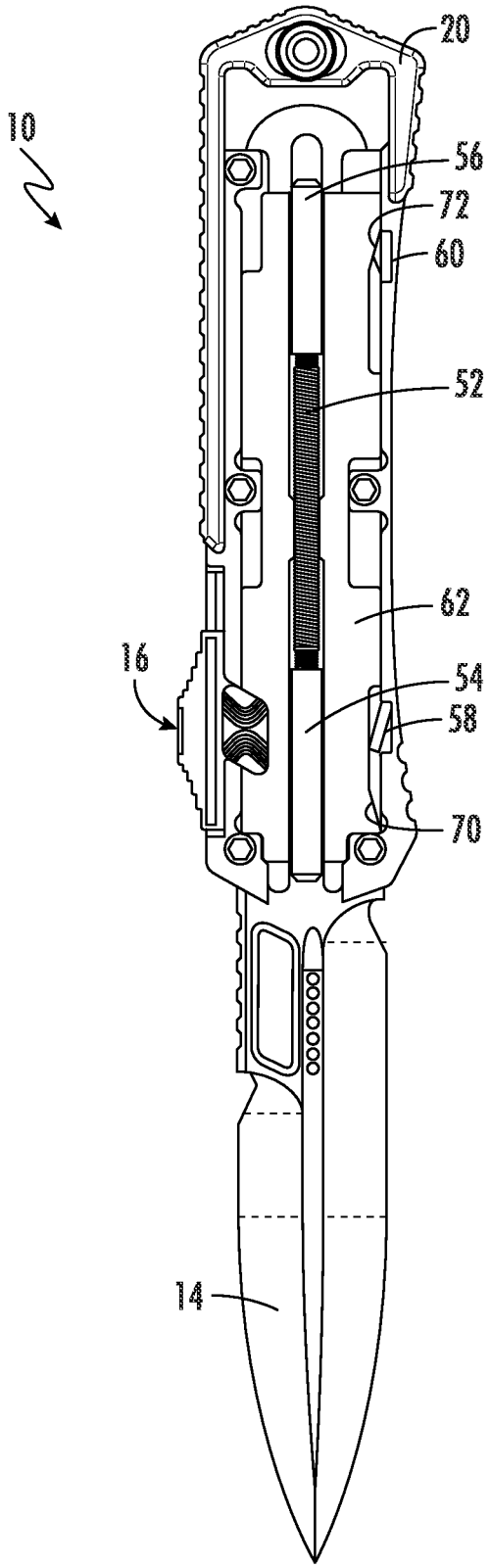
FIG. 10 is a left plan view of the pocket knife shown in FIGS. 1-3 with the left chassis and left scale removed, the blade in the deployed position, the actuator in the open position, the slider in the front position, and the front lock engaged with the blade.
Figure 11:
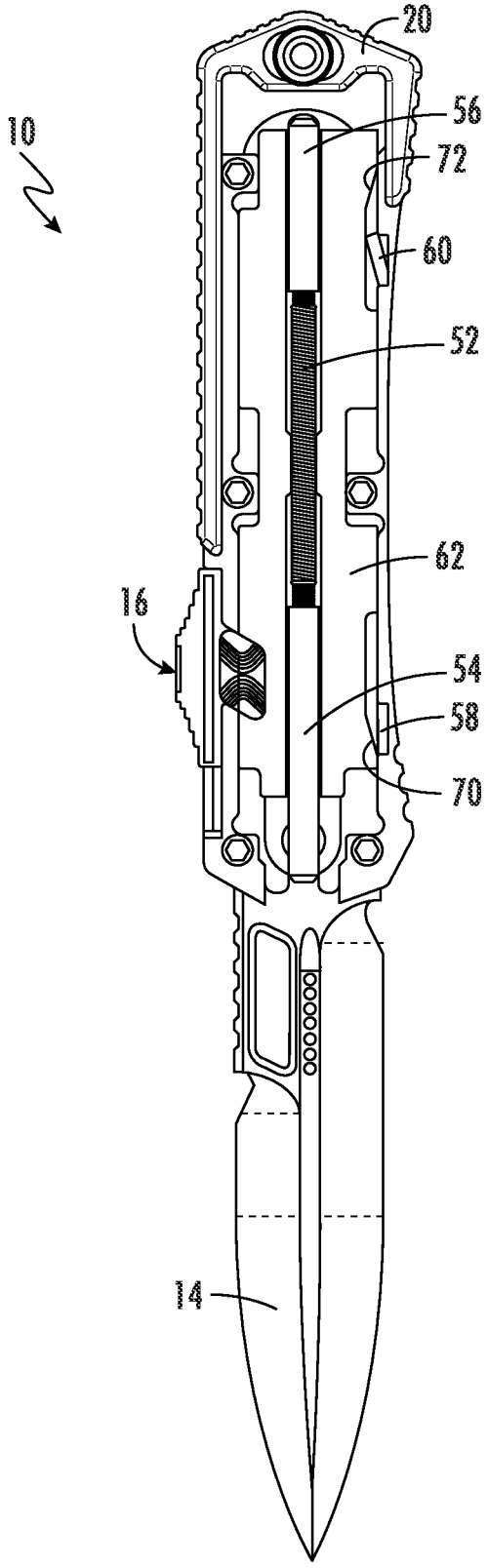
FIG. 11 is a left plan view of the pocket knife shown in FIGS. 1-3 with the left chassis and left scale removed, the blade in the deployed position, the actuator in the shut position, the slider in the rear position, and the front lock released from the blade.

The actuator 16 controls the operation of the pocket knife 10 and has a shut or rear position, shown in FIGS. 1, 8, and 11, that moves the blade 14 to the retracted position and an open or front position, shown in FIGS. 2, 9, and 10, that moves the blade 14 to the deployed position. The actuator 16 is in sliding contact with the chassis 12, and surfaces of the actuator 16 may extend beyond the left, right, and/or top outer surfaces 28, 30, 32 of the chassis 12 to enhance access to and gripping of the actuator 16. As shown most clearly in FIG. 4, for example, a top side 38 of the actuator 16 may extend beyond the top outer surface 32 of the chassis 12 so that a user holding the pocket knife 10 in one hand may use a thumb of that hand to slide the actuator 16 to the open and shut positions to alternately deploy and retract the blade 14. Alternately or in addition, a left side 40 of the actuator 16 may extend beyond the left outer surface 28 of the chassis 12, and a right side 42 of the actuator 16 may extend beyond the right outer surface 30 of the chassis 12. In this manner, a user may use a thumb and index finger to pinch the left and right sides 40, 42 of the actuator 16 to apply more force to reposition the actuator 16 to the open and shut positions. Alternate embodiments of the present invention may include any combination of the top, left, and/or right sides 38, 40, 42 of the actuator 16 as shown in FIG. 4, and the present invention is not limited to any particular combination unless recited in the claims.

Figure 5:
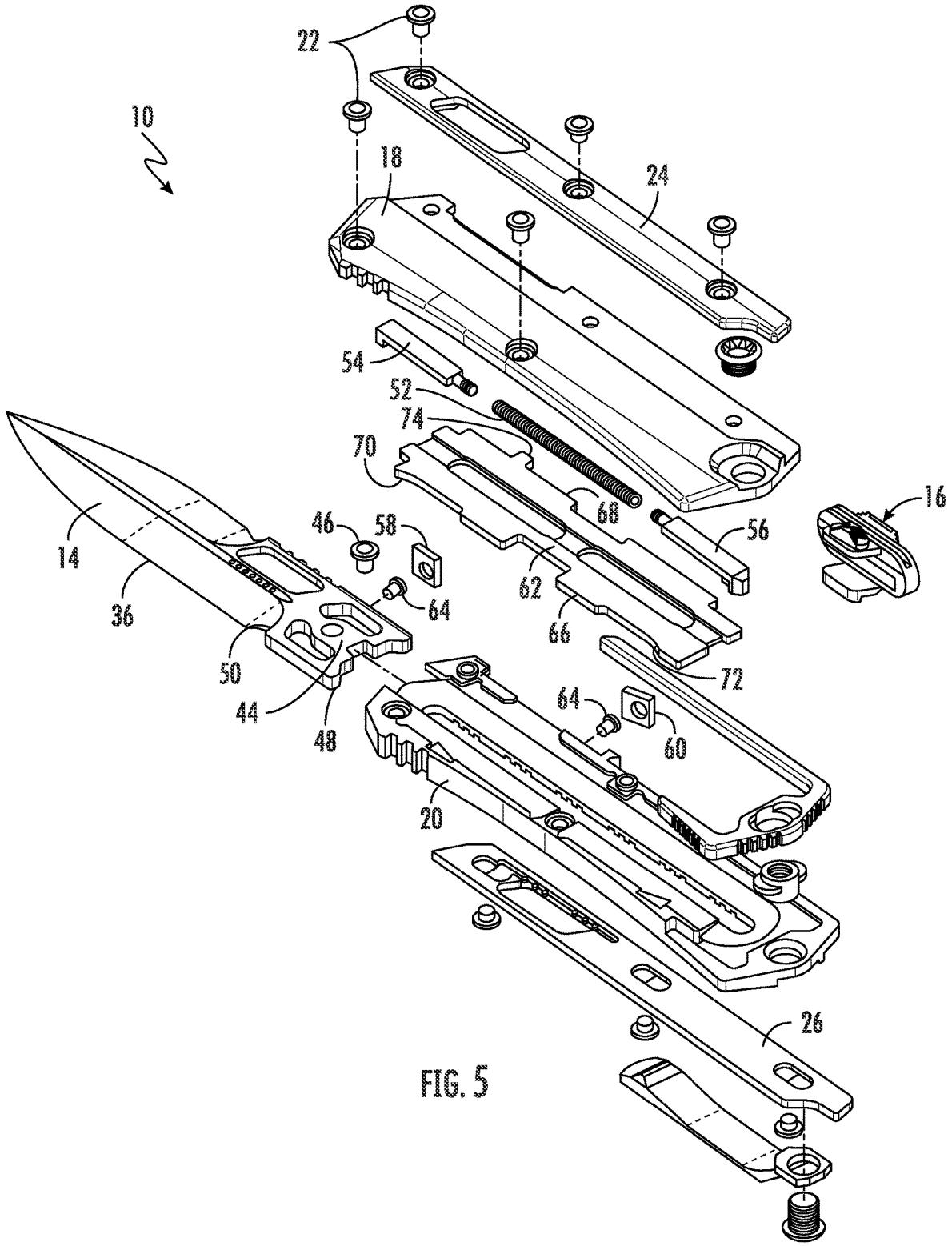
FIG. 5 an exploded view of the pocket knife shown in FIGS. 1-3.

FIG. 5 provides an exploded view of the pocket knife shown in FIGS. 1-3. As shown in FIG. 5, the rear portion of the blade 14 generally includes a tang 44, and the tang 44 of the blade 14 may include a post 46 longitudinally separated from a rear surface 48 and a notch 50 in one or both sides. In particular embodiments, the post 46 may be simply a projection from the tang 44, while in other embodiments, as shown in FIG. 5, the post 46 may be a separate part threaded or press-fit into the tang 44. The purpose and operation of the post 46, rear surface 48, and notch 50 will be described in more detail with respect to operation of the blade 14 between the retracted and deployed positions as shown in FIGS. 8-11.

As shown most clearly in FIG. 5, a spring 52, front and rear operators 54, 56, front and rear locks 58, 60, and a slider 62 may be located inside the cavity 34 of the chassis 12. The spring 52 connects the front operator 54 to the rear operator 56. In the particular embodiment shown in FIG. 5, the spring 52 is in threaded engagement with the front and rear operators 54, 56 so slight variations in the modulus of elasticity of the spring 52 may be compensated by increasing or decreasing the length of the threaded engagement with one or both of the front and rear operators 54, 56. As will be explained in more detail with respect to FIGS. 8-11, the front and rear operators 54, 56 alternately engage with the blade 14 and the slider 62 to move the blade 14 between the retracted and deployed positions.

The front and rear locks 58, 60 may be pivotally connected to the chassis 12 and biased inward in the cavity 34 by springs 64. In this manner, with the blade 14 in the retracted position, the rear lock 60 is in biased engagement with the notch 50 in the tang 44 to lock the blade 14 inside the chassis 12. Conversely, with the blade 14 in the deployed position, the front lock 58 is in biased engagement with the rear surface 48 of the tang 44 to lock the blade 14 outside of the chassis 12.

The slider 62 has a first side 66 opposed to a second side 68 and may include a front sloped surface 70 and a rear sloped surface 72 on either of the first or second sides 66, 68. In the particular embodiment shown in FIG. 5, the front and rear sloped surfaces 70, 72 are located or defined on the first side 66 of the slider 62 to engage with the front and rear locks 58, 60 as the slider 62 moves longitudinally in the cavity 34. In alternate embodiments, the front and rear sloped surfaces 70, 72 may be located or defined on opposite sides 66, 68 of the slider 62 to correspond to the positions of the associated front and rear locks 58, 60, and the present invention is not limited to the specific location of the front and rear sloped surfaces 70, 72 unless specifically recited in the claims.

A tab 74 may extend from whichever side of the slider 62 is closest to the actuator 16 so that the tab 74 engages with the actuator 16 and the actuator 16 and the slider 62 move together. In the particular embodiment shown in FIG. 5, for example, the tab 74 extends from the second side 68 of the slider 62. In this manner, forward or rearward movement of the actuator 16 moves the slider 62 the same direction and distance.

The slider 62 has a rear position that moves the blade 14 to the retracted position and a front position that moves the blade 14 to the deployed position. Specifically, with the slider 62 in the front position and the blade 14 locked in the deployed position, as the slider 62 moves to the rear position, the slider 62 engages with the rear operator 56 to create tension in the spring 52. Rearward movement of the slider 62 causes the front sloped surface 70 to engage with the front lock 58 to pivot the front lock 58 outward, disengaging the front lock 58 from the rear surface 48 of the tang 44 to allow the spring 52 to pull the front operator 54 against the post 46 in the tang 44 to move the blade 14 to the retracted position. Conversely, with the slider 62 in the rear position and the blade 14 locked in the retracted position, as the slider 62 moves to the front position, the slider 62 engages with the front operator 54 to create tension in the spring 52. Forward movement of the slider 62 causes the rear sloped surface 72 to engage with the rear lock 60 to pivot the rear lock 60 outward, disengaging the rear lock 60 from the notch 50 in the tang 44 of the blade 14 to allow the spring 52 to pull the rear operator 56 against the rear surface 48 of the tang 44 to move the blade 14 to the deployed position.

Figure 6:
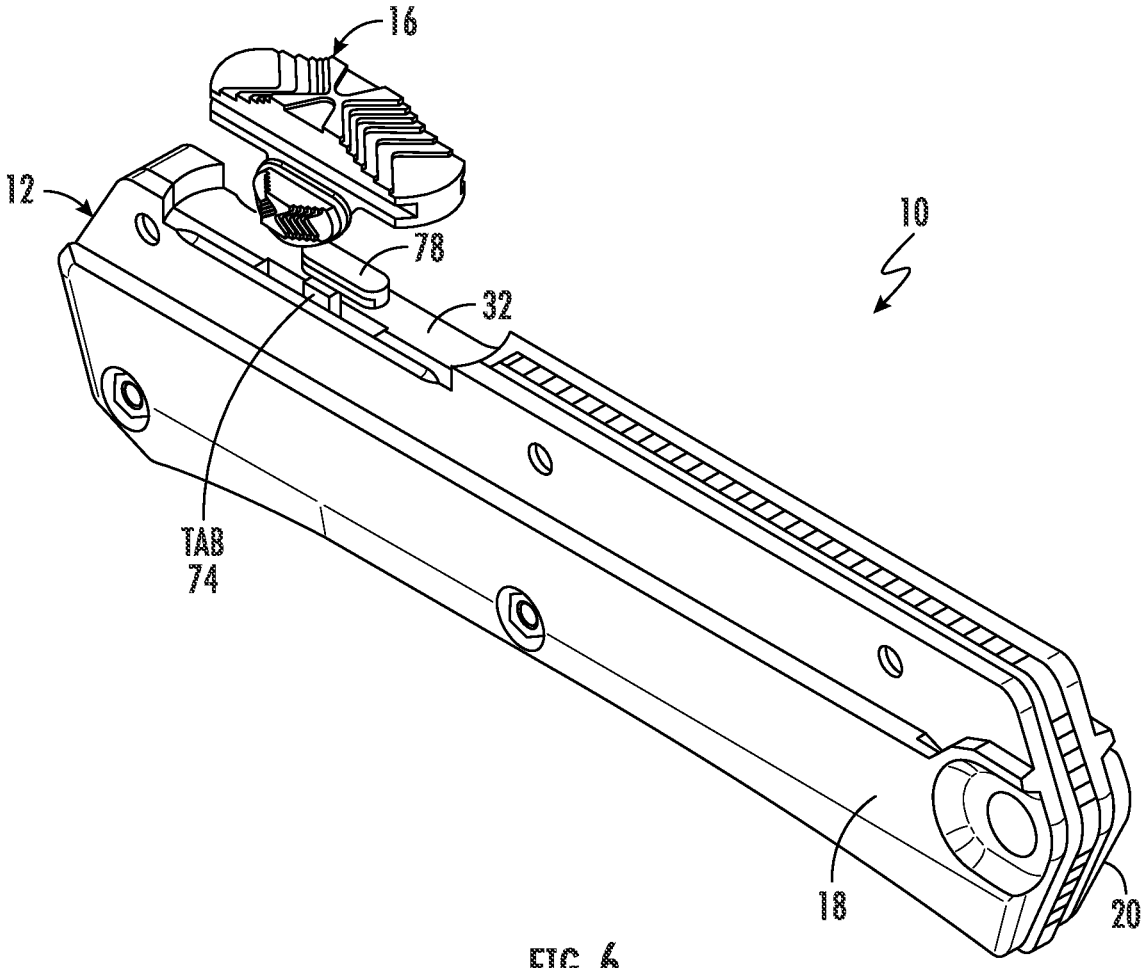
FIG. 6 is a partially exploded perspective view of the pocket knife shown in FIG. 1 with the left and right scales removed.
Figure 7:
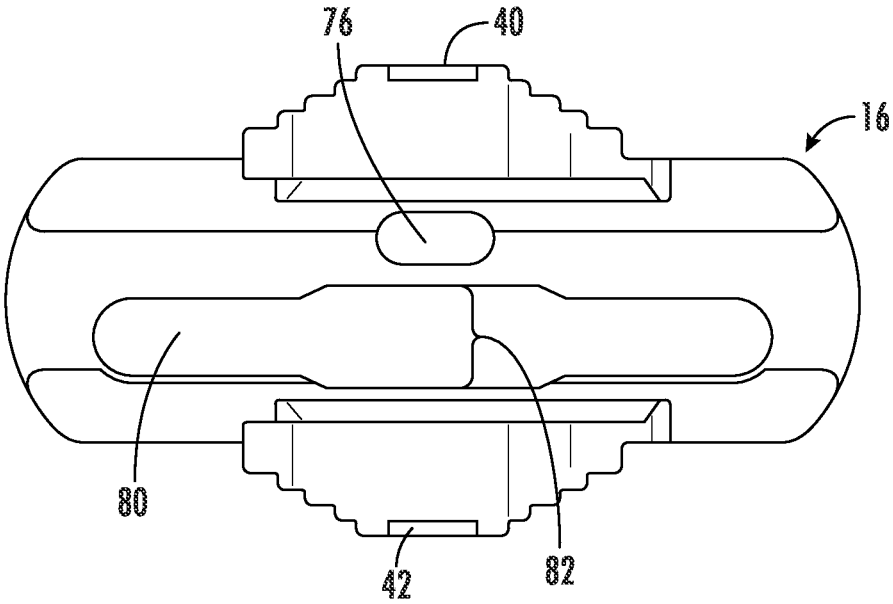
FIG. 7 is a bottom plan view of the actuator shown in FIGS. 1-6.

FIG. 6 provides a partially exploded perspective view of the pocket knife 10 shown in FIG. 1 with the left and right scales 24, 26 removed, and FIG. 7 provides a bottom plan view of the actuator 16 shown in FIGS. 1-6. As shown in FIGS. 6 and 7, the tab 74 extends from the slider 62 in the cavity 34 above the top outer surface 32 of the chassis 12 to engage with a complimentary recess 76 in the actuator 16 so the actuator 16 and the slider 62 move together. In addition, a T-shaped boss 78 may extend from the top outer surface 32 of the chassis 12 to slidingly engage with an extended recess 80 in the actuator 16 as the actuator 16 moves between the open and shut positions. In this manner, the T-shaped boss 78 may retain the actuator 16 engaged with the top outer surface 32 of the chassis 12 as the actuator 16 slides between the open and shut positions. The extended recess 80 may include a section 82 that is wider than the T-shaped boss 78. The wider section 82 of the extended recess 80 allows removal of the actuator 16 for repairs or replacement without requiring further disassembly of the chassis 12.

Operation of the pocket knife 10 between the retracted and deployed positions will now be described with respect to FIGS. 8-11. As shown in FIG. 8, the actuator 16 is in the shut position, and the slider 62 is in the rear position with the blade 14 retracted inside the cavity 34. With the blade 14 in the retracted position, the rear operator 56 is engaged with the rear surface 48 of the tang 44, and the rear lock 60 is engaged with the notch 50 in the tang 44 to retain the blade 14 in the retracted position.

To deploy the blade 14, the actuator 16 is moved forward to the open position as shown in FIG. 9, and the engagement between the tab 74 and the actuator 16 causes the slider 62 to move forward with the actuator 16. As the slider 62 initially moves forward, the rear lock 60 remains engaged with the notch 50 in the tang 44 to prevent the blade 14 from moving, and the front of the slider 62 engages with the front operator 54 to move the front operator 54 forward and create tension in the spring 52 between the front and rear operators 54, 56. Eventually, the rear sloped surface 72 on the first side 66 of the slider 62 disengages the rear lock 60 from the notch 50 to release the blade 14, as shown in FIG. 9.

When the rear lock 60 disengages from the notch 50, the tension in the spring 52 causes the rear operator 56 to eject the blade 14 out of the cavity 34 to the deployed position, as shown in FIG. 10. The blade 14 moves out of the cavity 34 until the post 46 contacts the front operator 54 to prevent further travel of the blade 14 out of the cavity 34. As shown in FIG. 10, the actuator 16 is in the open position with the blade 14 deployed outside of the cavity 34. In the deployed position, the front operator 54 is engaged with the post 46, and the front lock 58 is engaged with the rear surface 48 of the tang 44 to hold the blade 14 in the deployed position.

To retract the blade 14, the actuator 16 is moved rearward to the shut position as shown in FIG. 11, and the engagement between the tab 74 and the actuator 16 causes the slider 62 to move rearward with the actuator 16. As the slider 62 initially moves rearward, the front lock 58 remains engaged with the rear surface 48 of the tang 44 to prevent the blade 14 from moving, and the rear of the slider 62 engages with the rear operator 56 to move the rear operator 56 rearward and create tension in the spring 52 between the front and rear operators 54, 56. Eventually, the front sloped surface 70 on the first side 66 of the slider 62 disengages the front lock 58 from the rear surface 48 of the tang 44 to release the blade 14, as shown in FIG. 11.

When the front lock 58 disengages from the rear surface 48 of the tang 44, the tension in the spring 52 causes the front operator 54 to pull the blade 14 into the cavity 34 to the retracted position, as shown in FIG. 8. The blade 14 moves into the cavity 34 until the rear surface 48 of the tang 44 contacts the rear operator 56, and the rear lock 60 again engages with the notch 50 in the tang 44 to retain the blade 14 in the retracted position.

The embodiments described and illustrated with respect to FIGS. 1-11 provide several advantages over conventional double action pocket knives. For example, the addition of the left and/or right sides 40, 42 of the actuator 16 that extend beyond the left and right outer surfaces 28, 30 of the chassis 12 enhances access to and gripping of the actuator 16. As a result, a user may use a thumb and index finger to pinch the left and right sides 40, 42 of the actuator 16 to apply more force to reposition the actuator 16 to the open and shut positions. Alternately or in addition, the threaded engagement between the spring 52 and the front and/or rear operators 54, 56 allows for slight variations in the modulus of elasticity of the spring 52 to be compensated by increasing or decreasing the length of the threaded engagement with one or both of the front and rear operators 54, 56. As a result, embodiments of the present invention provide an improved pocket knife 10 that may be comfortably operated one-handed while accommodating manufacturing tolerances in the spring 52.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A pocket knife, comprising:

a chassis, wherein said chassis defines a left outer surface opposed to a right outer surface, a top outer surface between said left and right outer surfaces, and a cavity between said left and right outer surfaces;

a blade having a cutting edge, wherein said blade has a retracted position in which said cutting edge is inside said cavity and a deployed position in which said cutting edge is outside of said cavity;

an actuator in sliding contact with said chassis, wherein said actuator has a shut position that moves said blade to said retracted position and an open position that moves said blade to said deployed position;

a left side of said actuator that extends beyond said left outer surface of said chassis;

a right side of said actuator opposed to said left side of said actuator, wherein said right side of said actuator extends beyond said right outer surface of said chassis;

a top side of said actuator between said left and right sides of said actuator, wherein said top side of said actuator extends beyond said top outer surface of said chassis;

a boss that extends from said top outer surface of said chassis;

a recess defined in said actuator; and said boss slidingly engages with said recess of said actuator.

2. The pocket knife as in claim 1, further comprising a slider inside said cavity, a tab that extends from said slider, and said tab engages with said actuator so that said actuator and said slider move together.

3. The pocket knife as in claim 2, further comprising:

a front operator inside said cavity, wherein said slider engages with said front operator to move said blade to said deployed position;

a rear operator inside said cavity, wherein said slider engages with said rear operator to move said blade to said retracted position; and a spring that connects said front operator to said rear operator.

4. The pocket knife as in claim 1, further comprising a front lock inside said cavity and engaged with said blade in said deployed position.

5. The pocket knife as in claim 1, further comprising a rear lock inside said cavity and engaged with said blade in said retracted position.

6. A pocket knife, comprising:

a chassis, wherein said chassis defines a left outer surface opposed to a right outer surface, a top outer surface between said left and right outer surfaces, and a cavity between said left and right outer surfaces;

a blade having a cutting edge, wherein said blade has a retracted position in which said cutting edge is inside said cavity and a deployed position in which said cutting edge is outside of said cavity;

a slider inside said cavity, wherein said slider has a rear position that moves said blade to said retracted position and a front position that moves said blade to said deployed position;

a tab that extends from said slider;

an actuator in sliding contact with said chassis and engaged with said tab so that said actuator and said slider move together;

at least one of a left side of said actuator that extends beyond said left outer surface of said chassis or a right side of said actuator that extends beyond said right outer surface of said chassis; and a top side of said actuator that extends beyond said top outer surface of said chassis.

7. The pocket knife as in claim 6, further comprising a boss that extends from said top outer surface of said chassis, a recess defined in said actuator, and said boss slidingly engages with said recess of said actuator.

8. The pocket knife as in claim 6, further comprising a front operator inside said cavity, wherein said slider engages with said front operator to move said blade to said deployed position.

9. The pocket knife as in claim 6, further comprising a rear operator inside said cavity, wherein said slider engages with said rear operator to move said blade to said retracted position.

10. The pocket knife as in claim 6, further comprising:

a front operator inside said cavity, wherein said slider engages with said front operator to move said blade to said deployed position;

a rear operator inside said cavity, wherein said slider engages with said rear operator to move said blade to said retracted position; and a spring that connect said front operator to said rear operator.

11. The pocket knife as in claim 6, further comprising a front lock inside said cavity and engaged with said blade in said deployed position.

12. The pocket knife as in claim 6, further comprising a rear lock inside said cavity and engaged with said blade in said retracted position.

13. A pocket knife, comprising:

a chassis, wherein said chassis defines a left outer surface opposed to a right outer surface, a top outer surface between said left and right outer surfaces, and a cavity between said left and right outer surfaces;

a blade having a cutting edge, wherein said blade has a retracted position in which said cutting edge is inside said cavity and a deployed position in which said cutting edge is outside of said cavity;

a slider inside said cavity, wherein said slider has a rear position that moves said blade to said retracted position and a front position that moves said blade to said deployed position;

a tab that extends from said slider;

an actuator in sliding contact with said chassis and engaged with said tab so that said actuator and said slider move together;

a front operator inside said cavity, wherein said slider engages with said front operator to move said blade to said deployed position;

a rear operator inside said cavity, wherein said slider engages with said rear operator to move said blade to said retracted position; and a spring in threaded engagement with at least one of said front operator or said rear operator.

14. The pocket knife as in claim 13, further comprising at least one of a left side of said actuator that extends beyond said left outer surface of said chassis or a right side of said actuator that extends beyond said right outer surface of said chassis.

15. The pocket knife as in claim 14, further comprising a top side of said actuator that extends beyond said top outer surface of said chassis.

16. The pocket knife as in claim 13, further comprising a boss that extends from said top outer surface of said chassis, a recess defined in said actuator, and said boss slidingly engages with said recess of said actuator.

17. The pocket knife as in claim 13, further comprising a front lock inside said cavity and engaged with said blade in said deployed position.

18. The pocket knife as in claim 13, further comprising a rear lock inside said cavity and engaged with said blade in said retracted position.

* * * * *